United States Patent [19]

Mifune et al.

[11] Patent Number: 5,004,679

[45] **Date of Patent: * Apr. 2, 1991**

[54] SILVER HALIDE PHOTOGRAPHIC MATERIAL AND PROCESS FOR THE PREPARATION THEREOF

[75] Inventors: Hiroyuki Mifune; Shigeharu Urabe, both of Kanagawa, Japan

[73] Assignee: Fuji Photo Film Co., Ltd., Kanagawa, Japan

[ * ] Notice: The portion of the term of this patent subsequent to Nov. 7, 2006 has been disclaimed.

[21] Appl. No.: 462,382

[22] Filed: Jan. 9, 1990

[30] Foreign Application Priority Data

Jan. 9, 1989 [JP] Japan ..... 1-2465

[51] Int. Cl.[5] ..... G03C 1/005

[52] U.S. Cl. ..... 430/567; 430/569; 430/603

[58] Field of Search ..... 430/567, 569, 603

[56] References Cited

U.S. PATENT DOCUMENTS 2,642,361 6/1953 Damschroder et al. ..... 95/7
4,433,048 2/1984 Solberg et al. ..... 430/434
4,434,226 2/1984 Wilgus et al. ..... 430/567
4,565,778 1/1986 Miyamoto et al. ..... 430/567
4,665,017 5/1987 Mifune et al. ..... 430/569
4,764,457 8/1988 Hotta et al. ..... 430/569
4,879,208 11/1989 Urabe ..... 430/569

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A silver halide photographic material is disclosed which comprises at least one silver halide emulsion layer on a support, wherein light-sensitive silver halide grains in the silver halide emulsion layer or layers are obtained by charging previously prepared silver halide particles having a fine size into a reaction vessel which allows nucleation and/or crystallization of the light-sensitive silver halide grains so that nucleation and/or crystallization are effected in the reaction vessel, and the light-sensitive silver halide grains are subjected to chemical ripening in the presence of a silver halide solvent. A process for the preparation of the silver halide photographic material is also disclosed.

14 Claims, 1 Drawing Sheet

SILVER HALIDE PHOTOGRAPHIC MATERIAL AND PROCESS FOR THE PREPARATION THEREOF

FIELD OF THE INVENTION

The present invention relates to a silver halide photographic material and a process for the preparation thereof. More particularly, the present invention relates to a silver halide photographic material comprising silver halide grains having excellent preservability and improved developability, sensitivity, and antifogging properties, and a process for the preparation thereof.

BACKGROUND OF THE INVENTION

A silver halide emulsion to be incorporated in a silver halide photographic material is normally subjected to chemical sensitization with various chemical substances to obtain a desired sensitivity, gradation, etc. Typical examples of chemical sensitization include sulfur sensitization, selenium sensitization, noble metal sensitization with gold or the like, reduction sensitization, and combinations thereof.

In recent years, high sensitivity, excellent graininess and high sharpness have been desired properties for silver halide photographic material. Furthermore, processing silver halide photographic materials at a higher speed than ever has also been desired. Thus, many improvements have been made in the above-mentioned sensitization processes.

In addition to the above-mentioned chemical sensitization processes, a new process has been proposed which comprises adding a so-called silver halide solvent as described later to the system upon chemical ripening to further improve the sensitivity.

However, this process is disadvantageous in that it causes fogging or a sensitivity change (mostly desensitization) during the storage of the light-sensitive material. Thus, this process makes it difficult to make the best use of the sensitizing effect and produces only an insufficient result.

In general, silver halide grains are formed by reacting an aqueous solution of a silver salt with an aqueous solution of a halide in an aqueous colloidal solution in a reaction vessel. The single jet process which comprises adding an aqueous solution of a silver salt to a mixture of a protective colloid such as gelatin and an aqueous solution of a halide in a reaction vessel with stirring over a certain period of time and the double jet process which comprises adding an aqueous solution of a halide and an aqueous solution of a silver salt to an aqueous solution of gelatin in a reaction vessel for certain periods of time, respectively. By comparison, the double jet process provides silver halide grains having a narrower grain size distribution than the single jet process. In the double jet process, the halide composition can be freely altered as the growth of the grains progresses.

It is known that the growth rate of silver halide grains largely depends on the concentration of silver ions (halogen ions) in the reaction solution, the concentration of the silver halide solvent, the distance between the grains, the grain size, etc. In particular, the lack of uniformity in the concentration of silver ions or halogen ions produced by the addition of an aqueous solution of a silver salt and an aqueous solution of a halide results in different growth rates, giving a non-uniformity in the resulting silver halide emulsion. In order to eliminate this problem, it is necessary to rapidly and uniformly mix and react the aqueous solution of the silver salt with the aqueous solution of the halide in the aqueous solution of the colloid so as to provide uniformity in the concentration of the silver ions or the halogen ions in the reaction vessel. In the conventional process which comprises adding an aqueous solution of a halide and an aqueous solution of a silver salt to the surface of an aqueous solution of a colloid in a reaction vessel, portions of higher halogen ion and silver ion concentrations are produced in the vicinity of the location at which each reaction solution is added. This results in difficulty in the preparation of uniform silver halide grains. Methods for eliminating such an uneven concentration distribution are disclosed in U.S. Pat. Nos. 3,415,650, and 3,692,283,and British Patent 1,323,464. In these methods, a reaction vessel is filled with an aqueous solution of a colloid. The reaction vessel is equipped with a rotary convex cylindrical hollow mixer having slits in the wall thereof (filled with an aqueous solution of a colloid, preferably composed of an upper chamber and a lower chamber partitioned by a disc in the vessel). The axis of rotation of the mixer is vertical. The aqueous solution of the halide and the aqueous solution of the silver salt are supplied into the mixer, which is rotating at a high speed, at the top and bottom open ends through feed pipes so that they are rapidly mixed and reacted with each other. (If there are two chambers in the mixer, the two aqueous solutions supplied into the respective chamber are first diluted with an aqueous solution of the colloid present therein, and then they are rapidly mixed and reacted with each other in the vicinity of the outlet slits.) The silver halide grains thus formed are then introduced into the aqueous solution of the colloid in the reaction vessel by the centrifugal force produced by the rotation of the mixer.

On the other hand, JP-B-55-10545 (the term "JP-B" as used herein means an "examined Japanese patent publication") discloses a method for eliminating an uneven concentration distribution to prevent non-uniform growth of grains. In this method, an aqueous solution of a halide and an aqueous solution of a silver salt are separately supplied into a mixer filled with an aqueous solution of the colloid in a reaction vessel filled with an aqueous solution of the colloid from the bottom open end of the mixer through feed pipes. These reaction solutions are rapidly agitated and mixed with each other by a lower agitator (turbine impeller) provided in the mixer to effect the growth of silver halide. The resulting silver halide grains are immediately introduced into the aqueous solution of the colloid in the reaction vessel from the upper open end of the mixer by an upper agitator provided above the lower agitator.

JP-A-57-92523 (the term "JP-A" as used herein means an "unexamined published Japanese patent application") discloses a preparation method which is intended to eliminate such a non-uniformity in concentration. In this method, an aqueous solution of a halide and an aqueous solution of a silver salt are separately supplied into a mixer filled with an aqueous solution of a colloid in a reaction vessel filled with an aqueous solution of the colloid from a lower open end of the mixer. The two reaction solutions are diluted with the aqueous solution of the colloid and then rapidly mixed with each other by a lower agitator provided in the mixer. The resulting silver halide grains are immediately introduced into the aqueous solution of the colloid in the reaction vessel from an upper open end of the mixer. In this method and apparatus therefor, the two reaction solutions which have been, diluted with the aqueous solution of the colloid are passed through the clearance between the inner wall of the mixer and the tip of the agitator without being passed through the gaps between the impellers so that they are rapidly mixed and reacted with each other under a shearing force in the clearance to form silver halide grains.

These methods and apparatus can thoroughly eliminate the uneven distribution of concentration of silver ions and halogen ion in the reaction vessel. However, an uneven concentration distribution still exists in the mixer. In particular, a relatively large uneven concentration distribution exists in the vicinity of the nozzle through which the aqueous solution of the silver salt and the aqueous solution of the halide are supplied of the portion under the agitator and of the portions agitated. Furthermore, the silver halide grains supplied into the mixer together with the protective colloid are passed through these portions having an uneven concentration distribution. It should be particularly noted that the silver halide grains rapidly grow in these portions. In other words, these preparation methods and apparatus therefor are disadvantageous in that an uneven concentration distribution exists in the mixer, and the growth of grains takes place rapidly in the mixer, failing to accomplish the object of allowing uniform growth of the silver halide under conditions free of a concentration distribution difference.

In order to accomplish a more efficient mixing so as to eliminate the uneven concentration distribution of silver ions and halogen ions, additional attempts have been made. For example, a reaction vessel and a mixer are independently provided. An aqueous solution of a silver salt and an aqueous solution of a halide are supplied into the mixer where they are rapidly mixed with each other to effect the growth of silver halide grains. In a preparation method and apparatus disclosed in JP-A-53-37414 and JP-B-48-21045, an aqueous solution of a protective colloid (containing silver halide grains) is pumped from the bottom of a reaction vessel and circulated therein. A mixer is provided in the course of the circulation system. An aqueous solution of a silver salt and an aqueous solution of a halogen are supplied into the mixer where they are rapidly mixed with each other to effect the growth of silver halide grains. In a method disclosed in U.S. Pat. No. 3,897,935, an aqueous solution of a protective colloid (containing silver halide grains) is pumped from the bottom of a reaction vessel and circulated therein. An aqueous solution of a halide and an aqueous solution of a silver salt are pumped into the course of the circulation system. In a preparation method and apparatus disclosed in JP-A-53-47397, an aqueous solution of a protective colloid (containing silver halide grains) is pumped from the bottom of a reaction vessel and circulated therein. An aqueous solution of an alkali metal halide is first introduced into the circulation system. The aqueous solution of an alkali metal halide is diffused into the system until the system becomes uniform. Thereafter, an aqueous solution of a silver salt is introduced into and mixed with the system to form silver halide grains. These methods enable independent altering of the rate at which the aqueous solutions flow from the reaction vessel to the circulation system and the agitation efficiency of the mixer, making it possible to effect growth of grains under a condition of a more uniform concentration distribution. However, these methods are still disadvantageous in that the crystalline silver halide which has been delivered from the reaction vessel together with the protective colloid is subject to rapid growth at the inlet portion from which the aqueous solution of the silver salt and the aqueous solution of the halide are introduced into the system. Therefore, in these methods, it is impossible, in principle, to eliminate such a concentration distribution difference in the mixing portion or in the vicinity of the inlet portion. That is, the object of allowing uniform growth of silver halide under a condition free of concentration distribution cannot be accomplished.

In order to overcome these problems, the inventors disclosed silver halide grains having a completely uniform halogen distribution therein, no halide composition distribution between grains and/or no reduced silver produced upon the formation of grains or no distribution of reduced silver between grains, and a light-sensitive material comprising such silver halide grains in JP-A-1-183417, JP-A-1-183644 and JP-A-1-183645.

SUMMARY OF THE INVENTION

It is therefore an object of the present invention to provide a high speed silver halide photographic material which causes little fogging.

It is another object of the present invention to provide a silver halide photographic material suited for rapid processing and having an excellent preservability and/or excellent spectral-sensitizability by a dye.

These objects of the present invention are accomplished with a silver halide photographic material comprising at least one silver halide emulsion layer on a support, wherein light-sensitive silver halide grains in said at least one silver halide emulsion layer are obtained by charging previously prepared silver halide particles having a fine size into a reaction vessel which allows at least one of nucleation and crystallization of said light-sensitive silver halide grains so that at least one of nucleation and crystallization is effected in said reaction vessel, and said light-sensitive silver halide grains are subjected to chemical ripening in the presence of a silver halide solvent.

These objects of the present invention are also accomplished by a process for the preparation of a silver halide photographic material comprising at least one silver halide emulsion layer on a support, wherein light-sensitive silver halide grains in said at least one silver halide emulsion layers are obtained by charging previously prepared silver halide particles having a fine size into a reaction vessel which allows at least one of nucleation and crystallization of said light-sensitive silver halide grains so that at least one of nucleation and crystallization is effected in said reaction vessel, and said light-sensitive silver halide grains are subjected to chemical ripening in the presence of a silver halide solvent.

In a preferred embodiment, the silver halide particles having a fine size are formed by mixing an aqueous solution of a water-soluble silver salt and an aqueous solution of a water-soluble halide in a mixer provided outside said reaction vessel which allows at least one of nucleation and crystallization of lightsensitive silver halide grains. The resulting silver halide particles are immediately supplied into said reaction vessel so that they are used for at least one of nucleation and crystallization of said lightsensitive sensitive silver halide grains.

In accordance with the present invention, the sensitizing effect resulting from the use of a silver halide solvent upon a chemical ripening, which is difficult to attain in the prior art techniques, can be optimized.

BRIEF DESCRIPTION OF THE DRAWINGS

By way of example and to make the description more clear, reference is made to the accompanying drawings in which.

DETAILED DESCRIPTION OF THE INVENTION

For the process for the preparation of a light-sensitive silver halide grains according to the present invention and the process for the preparation of "finely divided silver halide particles" to be used, reference can be made to the description in JP-A-1-183417, JP-A-1-183644 and JP-A-1-183645.

The term "nucleus" as used herein means grains in the stage wherein the number of silver halide crystals fluctuates during the formation of emulsion grains. Grains in the stage wherein the number of silver halide crystals does not change and only the growth on the nuclei takes place are referred to as "grains only under growth". In the nucleation process, the production of new nuclei, the elimination of existing nuclei and the growth of nuclei take place at the same time.

In the present invention, it is important to avoid addition of an aqueous solution of a silver salt and an aqueous solution of a halide for nucleation and/or growth of grains except for pAg adjustment of the emulsion in the reaction vessel. It is also important to avoid circulation of the aqueous solution of the protective colloid (containing silver halide grains) from the reaction vessel to the mixer.

Figure 1:
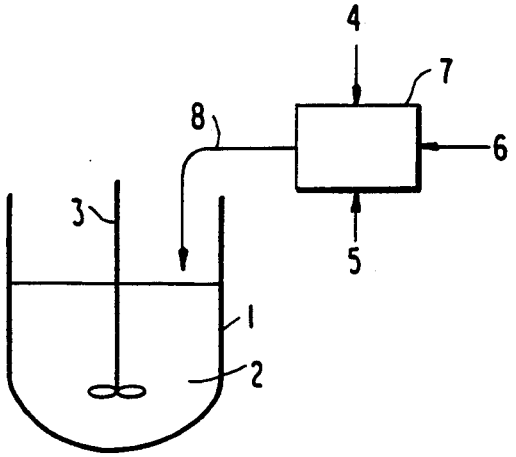
FIG. 1 is a schematic diagram illustrating a part of the process of the present invention.

In the process for the formation of silver halide grains, for example, the following process as illustrated in FIG. 1 may be employed.

In FIG. 1, a reaction vessel 1 contains an aqueous solution of protective colloid 2. The aqueous solution of protective colloid 2 is agitated by a propeller 3 mounted on a rotary shaft. An aqueous solution of silver salt, an aqueous solution of halide and an aqueous solution of protective colloid are introduced into a mixer 7 provided outside the reaction vessel through addition systems 4, 5 and 6, respectively. (In this case, the aqueous solution of protective colloid may be added in the form of a mixture with the aqueous solution of halide and/or aqueous solution of silver salt.) These solutions are rapidly and strongly mixed with each other in the mixer 7. The mixture is immediately introduced into the reaction vessel 1 through a system 8.

Figure 2:
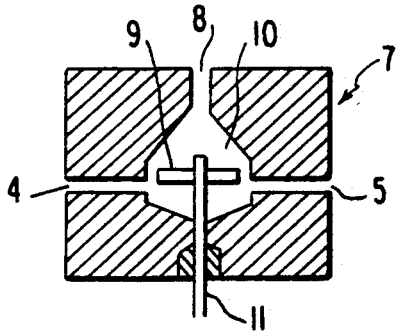
FIG. 2 is a detail view of a mixer of the present invention.

FIG. 2 is a detailed view of the mixer 7. The mixer 7 comprises a reaction chamber 10 provided therein. In the reaction chamber 10, an agitator 9 mounted on a rotary shaft 11 is provided. An aqueous solution of silver salt, an aqueous solution of halide and an aqueous solution of protective colloid are charged into the reaction chamber 10 from two inlets 4 and 5 and another inlet (not shown). When the rotary shaft is rotated at a high speed (1,000 r.p.m. or higher, preferably 2,000 r.p.m. or higher, particularly 3,000 r.p.m.), these reaction solutions are rapidly and thoroughly mixed with each other, and the resulting solution containing extremely fine particles is immediately discharged from an outlet 8. The extremely fine particles thus formed from the reaction in the mixer can be easily dissolved in the emulsion in the reaction vessel due to its extremely fine size to become provide silver ions and halogen ions again which cause the growth of uniform grains. The halide composition of the extremely fine particles is adjusted to equal that of the desired silver halide grains. The extremely fine particles thus introduced into the reaction vessel are scattered in the reaction vessel by the agitation in the reaction vessel. At the same time, individual extremely fine particles release halogen ions and silver ions of the desired halide composition. The particles produced in the mixer are extremely fine, and their number is very large. Since silver ions and halogen ions (in the case of the growth of mixed crystal, silver ions and halogen ions of the desired halogen ion composition) are released from a relatively large number of particles, and this takes place throughout the protective colloid in the reaction vessel, the growth of completely uniform grains can be achieved. It should be noted that silver ions and halogen ions must not be charged into the reaction vessel in the form of an aqueous solution except for the purpose of adjusting the pAg. It should also be noted that the protective colloid solution must not be circulated from the reaction vessel to the mixer. In this respect, the present process is quite different from the conventional process. In accordance with the present process, a surprising effect can be achieved in the uniform growth of silver halide grains.

The finely divided particle formed in the mixer exhibit a relatively high solubility due to their fine particle size. Therefore, when charged into the reaction vessel, the finely divided particles are dissolved in the solution therein to become silver ions and halogen ions again which are then deposited on existing grains in the reaction vessel to effect the growth of grains. However, the finely divided particles are subject to so-called Ostwald ripening of each other due to their high solubility, and this increases their particle size. The larger the size of the finely divided particles is, the lower is the solubility thereof. This retards the solution of the particles in the reaction vessel, remarkably lowering the rate of growth of grains. In some cases, the particles are no longer dissolved and become nuclei themselves to undergo growth.

In the present invention, the above described problems can be solved by the methods described in JP-A-1-183417, as follows:

(i) Finely divided particles are formed in a mixer, and the resulting finely divided particles are immediately charged into a reaction vessel.

In the present invention, a mixer is provided close to the reaction vessel and the retention time of the solutions charged in the mixer is shortened. Accordingly, by immediately charging the resulting finely divided particles into the reaction vessel, Ostwald ripening can be avoided. Specifically, the retention time t of the solutions charged in the mixer can be represented by the following equation:

$$t = \frac{v}{a + b + c}$$

wherein v: volume (ml) of the reaction chamber in the mixer;

a: amount (ml/min) of the aqueous silver salt solution added;

b: amount (ml/min of the aqueous halide solution added; and c: amount (ml/min) of the protective colloid solution added In the present preparation process, t is in the range of 10 minutes or less, preferably 5 minutes or less, more preferably 1 minute or less, particularly 20 seconds or less but 2 seconds or more. Thus, the finely divided particles formed in the mixer are immediately charged into the reaction vessel without increasing their particle size.

(ii) A vigorous and efficient agitation is achieved in the mixer.

T.H. James, *The Theory of the Photographic Process*, 4th Ed., pp. 93, MacMillan 1977 states "Another type of grain growth that can occur is coalescence. In coalescence ripening, an abrupt change in size occurs when pairs or larger aggregates of crystals are formed by direct contact and welding together of crystals that were once widely separated. Both Ostwald and coalescence ripening may occur during precipitation, as well as after precipitation has stopped". Coalescence ripening as referred to herein tends to take place when the grain size is very small, particularly when the agitation is insufficient. In some extreme cases, gross lumps of grains are formed. In the present invention, a closed type mixer is used as shown in FIG. 2. Therefore, the agitator in the reaction chamber can be rotated at a high speed. Thus, a vigorous and efficient agitated mixing, which cannot be accomplished by the conventional open type reaction vessel, can be achieved. (In such an open type reaction vessel, when the agitator is rotated at a high speed, the solution is scattered by the centrifugal force. This high speed rotation also involves foaming of the material. Therefore, this high speed rotation in the open type reaction vessel is not practical.) Furthermore, the above described coalescence ripening can be prevented. As a result, finely divided particles having a relatively small particle size can be obtained. In the present invention, the number of revolutions of the agitator is 1,000 r.p.m. or more, preferably 2,000 r.p.m. or more, particularly 3,000 r.p.m. or more and not more than 10,000 r.p.m.

(iii) An aqueous solution of protective colloid is charged into a mixer.

The above described coalescence ripening can be markedly prevented by the use of a protective colloid. In the present invention, the charging of the aqueous solution of protective colloid into the mixer is accomplished in the following manner.

(a) An aqueous solution of protective colloid is singly charged into the mixer.

The concentration of the protective colloid is in the range of 0.2% by weight or more and preferably 0.5% by weight or more. The flow rate at which the aqueous solution of protective colloid is charged into the mixer is at least 20% and not more than 300%, preferably at least 50%, more preferably 100% or more of the sum of the flow rate of the aqueous solution of silver salt and the aqueous halide solution.

(b) A protective colloid is incorporated in an aqueous halide solution.

The concentration of the protective colloid is 0.2% by weight or more and preferably 0.5% by weight or more.

(c) A protective colloid is incorporated in an aqueous solution of silver salt.

The concentration of the protective colloid is 0.2% by weight or more and preferably 0.5% by weight or more. If gelatin is used, gelatin silver is formed of silver ion and gelatin. The gelatin silver undergoes photolytic degradation and thermal decomposition to form silver colloid. Therefore, the silver salt solution and the protective colloid solution are preferably mixed just before use.

The above described approaches (a) to (c) may be used alone or in combination. The three methods can be used at the same time.

In the present invention, as disclosed in the above cited JP-A-1-183644 and JP-A-1-183645, a process which comprises charging previously prepared finely divided silver halide particle emulsion containing particles having a minute size into a reaction vessel to effect nucleation and/or grain growth can be used. In this case, the particle size of the previously prepared emulsion is preferably smaller as described above. In this method, too, an aqueous solution of a water-soluble silver salt and an aqueous solution of a water-soluble halide are not charged into the reaction vessel which causes nucleation and/or grain growth except for the purpose of adjusting the pAg of the emulsion in the reaction vessel. Prior to being charged into the reaction vessel, the previously prepared emulsion may be rinsed.

The halide composition of the emulsion to be used in the present invention is any of silver bromoiodide, silver bromochloride, silver bromochloroiodide and silver chloroiodide. In accordance with the present invention, silver halide mixed crystal grains can be obtained with a microscopically uniform or "completely uniform" halide distribution as described in JP-A-1-183417, JP-A-1-183644 and JP-A-183645. Such silver halide mixed crystal grains can be obtained with any halide composition.

Furthermore, the present process is also very effective for the preparation of pure silver bromide, pure silver chloride, etc. In accordance with the prior art preparation process, the presence of local distribution of silver ion and halogen ion in the reaction vessel is inevitable. When silver halide grains in the reaction vessel pass through such a local nonuniform portion, they are put in an environment different from the uniform portion. This causes nonuniformity in the grain growth. Furthermore, reduced silver or fogged silver is produced in a high silver ion concentration portion. Therefore, in the case where another nonuniformity is produced as described above, no nonuniform halide distribution is produced.

This problem can be completely solved in the present emulsion. It is believed that the present invention enables the full use of a sensitizing effect obtained by the combined use of a silver halide solvent upon chemical ripening, which cannot be attained by the prior art processes. This was a surprising, unanticipated effect.

The silver halide grains according to the present invention may have a regular crystal form (normal crystal form) such as a cube, octahedron, dodecahedron, tetradecahedron, tetracosahedron and tetraxisoctahedron, an irregular crystal form such as a sphere and a potato-shaped form or a form having one or more twinning planes, particularly a hexagonal or triangular tablet having two or three parallel twinning planes.

The photographic emulsion of the present invention is prepared by the above-described process but may be partially prepared by the prior art process. The photographic emulsion layer in the present photographic light-sensitive material may contain a photographic emulsion which has not been prepared by the present preparation method. The preparation of such a photographic emulsion can be accomplished by any method as described in P. Glafkides, *Chimie et Physique Photographique,* Paul Montel, 1967, G. F. Duffin, *Photographic Emulsion Chemistry,* Focal Press, 1966, and V. L. Zelikman et al, *Making and Coating Photographic Emulsion,* Focal Press, 1964. More specifically, the emulsion can be prepared by the acid process, the neutral process, the ammonia process, etc. The reaction between a soluble silver salt and a soluble halogen can be carried out by a single jet process, a double jet process, a combination thereof, and the like. A method in which grains are formed in the presence of excess silver ions (the so-called reverse mixing method) may be used. Furthermore, a so-called controlled double jet process, in which the pAg value of a liquid phase in which silver halide grains are formed is maintained constant, may also be used. According to the controlled double jet process, a silver halide emulsion having a regular crystal form and an almost uniform grain size can be obtained.

The silver halide emulsion comprising the above-mentioned regular grains can be obtained by controlling pAg and pH values during grain formation. For details, one can refer to, e.g., *Photographic Science and Engineering,* Vol. 6, pp. 159 to 165, 1962, *Journal of Photographic Science,* Vol. 12, pp. 242 to 251, 1964, U.S. Pat. No. 3,655,394, and British Patent 1,413,748.

The silver halide solvent to be used in the present invention is capable of dissolving silver chloride in water or a mixture of water and an organic solvent (e.g., water methanol = 1/1) in the presence of 0.02 M of the silver halide solvent such that the amount of silver chloride dissolved is twice the weight of silver chloride soluble at 60° C. in the absence of the silver halide solvent.

Examples of such a silver halide solvent are listed below, but the present invention is not limited to these examples in any way:

(i) thiocyanates;

(ii) thioether compounds, selenaether compounds, and telluroether compounds (e.g., compounds as described in U.S. Pat. Nos. 2,521,926, 3,021,215, 3,038,805, 3,046,132, 3,574,628, 4,276,374, 3,704,130, 4,297,439, 4,752,560, 4,695,534, 4,695,535, 4,713,322 and 4,782,013, JP-B-58-30571, JP-A-57-104926, JP-A-60-80840, JP-A-62-14646, JP-A-62-23035, JP-A-63-259653, JP-A-63-26152, JP-A-1-121845, JP-A-1-121846, JP-1-121847, JP-A-1-209440, JP-A-1-210945, JP-A-1-216337, JP-A-1-216338 and JP-A-1-217450, (iii) thiocarbonyl compounds and selenocarbonyl compounds (e.g., 4-substituted thioureas as described in JP-B-58-51252, JP-B-59-11892 JP-A-55-77737 and U.S. Pat. Nos. 4,221,863 and 4,749,646 and compounds as described in JP-B-60-11341);

(iv) specific mercapto compounds and mesoionic compounds (e.g., compounds as described in JP-B-63-29727 and JP-A-60-163042);

(v) sulfites; and (vi) compounds containing an imino group (e.g., compounds as described in JP-B-62-2301 and JP-B-59-45135, and JP-A-57-82833, JP-A-57-188036, JP-A-57-196228 and JP-A-58-54333).

Preferred among these compounds are those belonging to the groups (i) to (v).

More specifically, a preferred example of the compounds belonging to the group (ii) is a compound represented by the general formula (I):

$$R^1\text{-}(X_2\text{-}R^3)_m\text{-}X_1\text{-}R^2 \quad \text{(I)}$$

wherein m represents 0 or an integer of 1 to 12.

$X_1$ and $X_2$ each represents a sulfur atom, selenium atom, tellurium atom or oxygen atom, with the proviso that at least one of $X_1$ and $X_2$ is a sulfur atom, selenium atom or tellurium atom, preferably a sulfur atom.

$R^1$ and $R^2$ my be the same or different and each represents a lower alkyl group preferably having 1 to 5 carbon atoms or a substituted alkyl group preferably having 1 to 30 carbon atoms in total (i.e., including carbon atoms in the substituents thereof).

Examples of substituents for the substituted alkyl group include —OH, —COOM$^1$, —SO$_3$M$^1$, —NHR$^4$, —NR$^4$R$^4$, —N⊕R$^4$R$^4$R$^4$ (in which R$^4$'s may be the same or different), —OR$^4$, —CONHR$^4$, —COOR$^4$, and heterocyclic groups such as a nitrogen-containing ring (e.g., a pyridine ring and an imidazole ring) and a furyl ring.

M$^1$ represents a hydrogen atom or cation.

R$^4$ may represent a hydrogen atom, lower alkyl group preferably having 1 to 5 carbon atoms or substituted alkyl group containing the above-mentioned substituents and preferably having 1 to 30 carbon atoms in total.

The substituted alkyl group for R$^1$, R$^2$ or R$^4$ may contain two or more substituents which may be the same or different.

R$^3$ represents an alkylene group preferably having 1 to 12 carbon atoms.

When m is 2 or more, the plurality of X$_2$'s and R$^3$'s may be the same or different.

The alkylene chain of R$^3$ may contain one or more groups such as —O—, —CONH— and —SO$_2$NH— therein or may be substituted by substituents described for R$^1$ and R$^2$.

R$^1$ and R$^2$ may be bonded to each other to form a cyclic compound.

A preferred example of the compounds belonging to the group (iii) is a compound represented by the general formula (II):

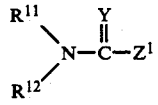

(II)

wherein Z$^1$ represents

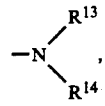

—OR$^{15}$ or —SR$^{16}$; and Y represents a sulfur atom, selenium atom or tellurium atom, preferably a sulfur atom.

R$^{11}$, R$^{12}$, R$^{13}$, R$^{14}$, R$^{15}$ and R$^{16}$ may be the same or different, and each represents an alkyl group, alkenyl group, aralkyl group, aryl group or heterocyclic residue (e.g., a nitrogen-containing ring, a furyl ring, etc.) which may be substituted by substituents as described for R$^1$ and R$^2$, each group preferably having 30 carbon atoms or less.

R$^{11}$ and R$^{12}$, R$^{13}$ and R$^{14}$, R$^{11}$ and R$^{13}$, R$^{11}$ and R$^{15}$, or R$^{11}$ and R$^{16}$ may be bonded to each other to form a 5-or 6-membered heterocyclic group which may contain substituents as described for R$^1$ and R$^2$.

A preferred example of the mercapto compound among the compounds belonging to the group (iv) is a compound represented by the general formula (III):

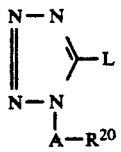

(III)

wherein A represents an alkylene group; $R^{20}$ represents $-NH_2$, $-NHR^{21}$,

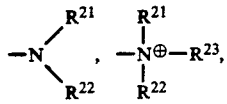

$-CONHR^{24}$, $-OR^{24}$, $-COOM^2$, $-COOR^{21}$, $-SO_2NHR^{24}$, $-NHCOR^{21}$ or $-SO_3M^2$, which preferably contains 30 carbon atoms or less; and L represents $-S^{\ominus}$ when $R^{20}$ is

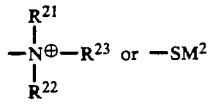

otherwise.

$R^{21}$, $R^{22}$ and $R^{23}$ each represents an alkyl group which may be substituted by substituents as described for $R^1$ and $R^2$.

$R^{24}$ represents a hydrogen atom or an alkyl group which may be substituted by substituents as described for $R^1$ and $R^2$.

$M^2$ represents a hydrogen atom or cation such as an alkali metal ion or ammonium ion.

A preferred example of the mesoionic compound among the compounds belonging to the group (iv) is a compound represented by the general formula (IV):

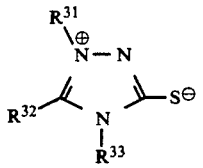

(IV)

Wherein $R^{31}$ and $R^{32}$ each represents an alkyl group, alkenyl group, aryl group, aralkyl group or heterocyclic residue (e.g., a nitrogen-containing ring, a furyl ring etc.) which may be substituted by substituents as described for $R^1$ and $R^2$. These groups each preferably contain 16 carbon atoms or less.

$R^{33}$ represents an alkyl group, alkenyl group, cycloalkyl group, aryl group, aralkyl group, heterocyclic residue (e.g., a nitrogen-containing ring, a furyl ring etc.), $-NH_2$, $-NHR^{21}$ or $-NR^{21}R^{22}$ wherein $R^{21}$and $R^{22}$ are the same as defined in the formula (III). These groups may be substituted by substituents as described for $R^1$ and $R^2$. These groups each preferably contain 16 carbon atoms or less, more preferably 10 carbon atoms or less.

$R^{31}$ and $R^{32}$ or $R^{32}$ and $R^{33}$ may be bonded to each other to form a 5- or 6-membered carbocyclic or heterocyclic ring.

$R^{31}$, $R^{32}$ and R33 each are preferably lower alkyl groups containing 6 carbon atoms or less or are such that $R^{31}$ and $R^{32}$ together form a ring. More preferably, they each are lower alkyl groups.

The synthesis of these compounds can be accomplished by any suitable method as described in the above-cited patents or references Some of these compounds are commercially available.

Specific examples of silver halide solvents to be used in the present invention are listed below, but the present invention is not limited to these examples in any way:

(1) KSCN
(2) $NH_4SCN$
(3) $HO(CH_2)_2S(CH_2)_2OH$
(4) $HO-(CH_2)_6S(CH_2)_5S(CH_2)_6OH$
(5) $HO-(CH_2)_2-S-(CH_2)_2-S-(CH_2)_2-OH$
(6) $HO-(CH_2)_3-S-(CH_2)_2-S-(CH_2)_3-OH$
(7) $HO-(CH_2)_6-S-(CH_2)_2-S-(CH_2)_6-OH$
(8) $HO(CH_2)_2S(CH_2)_2S(CH_2)S(CH_2)OH$
(9) $HO(CH_2)_2S(CH_2)_2O(CH_2)_2O(CH_2)_2S(CH_2)_2OH$
(10) $HOOCCH_2S(CH_2)_2SCH_2COOH$
(11) $H_2NCO(CH_2)_2S(CH_2)_2S(CH_2)_2CONH_2$
(12) $NaO_3S(CH_2)_3S(CH_2)_2S(CH_2)_3SO_3Na$
(13)
$(CH_3)_3N^{61}(CH_2)_3S(CH_2)_2S(CH_2)_3N^{\oplus}(CH_3)_3 \cdot 2PTS^{61}$
(PTS: paratoluene sulfonate)

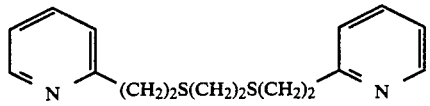

(14)

$HOCH_2CHCH_2S(CH_2)_2SCH_2CHCH_2OH$ (15)
OH OH $HOOCCHCH_2S(CH_2)_2SCH_2CHCOOH$ (16)
$NH_2$ $NH_2$ $HOOC(C_2H_4S)_2CH_2CHCH_2(SC_2H_4)_2COOH$ (17)
OH

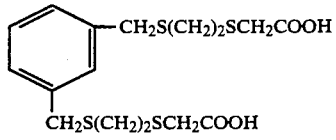

(18)

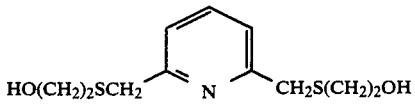

(19)

$[HO(CH_2)_2S(CH_2)_2CONH]_2CH_2$ (20)

$N(CH_2CH_2SCH_2CH_2N(CH_3)_2)_3.4HCl$ (21)

$(CH_3)_2N(C_2H_4S)_3(CH_2)_2N(CH_3)_2.2HCl$ (22)

$HOC_2H_4SC_2H_4SCH_2CHOHCH_2SC_2H_4SC_2H_4OH$ (23)

-continued
(24)
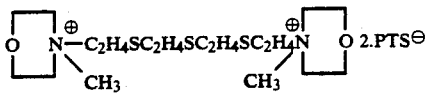
(25)
$CH_3SCH_2CH(NH_2)COOH$
(26) $C_2H_5SC_2H_4SC_2H_4NHCOC_2H_4COOH$
(27) $HOC_2H_4SeC_2H_4OH$
(28) $HOC_2H_4SeC_3H_6SeC_2H_4OH$
(29) $HOC_2H_4TeC_2H_4OH$
(30) $HOC_2H_4TeC_2H_4SC_2H_4OH$
(31)
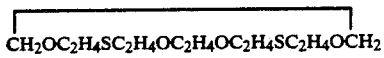
(32)
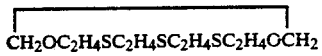
(33)
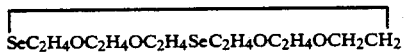
(34)
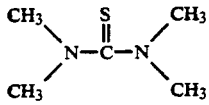
(35)
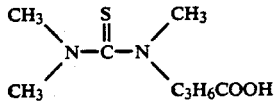
(36)
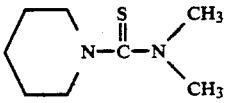
(37)
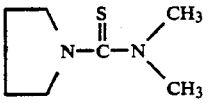
(38)
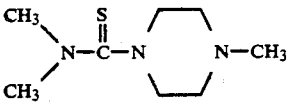
(39)
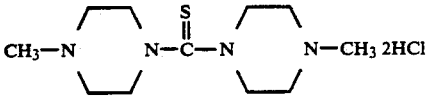
(40)
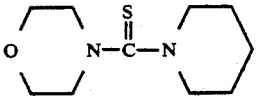
(41)
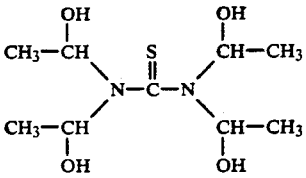
-continued
(42)
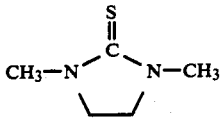
(43)
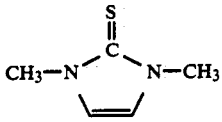
(44)
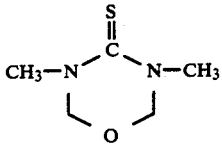
(45)
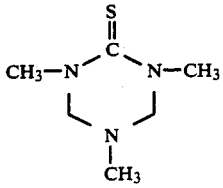
(46)
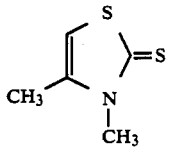
(47)
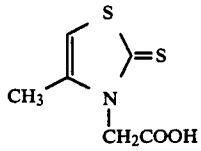
(48)
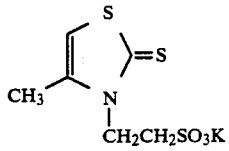
(49)
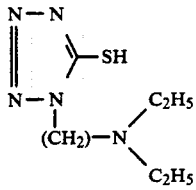
(50)
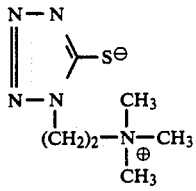
(51)
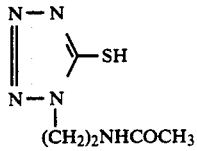

-continued (52)

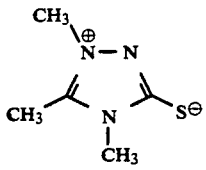

(53)

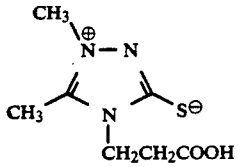

(54)

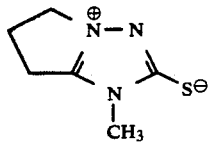

(55)

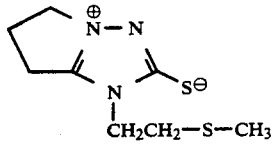

In the present invention, the chemical sensitization is accomplished by sulfur sensitization, selenium sensitization, noble metal sensitization or reduction sensitization, singly or in combination.

In the sulfur sensitization process, an unstable sulfur compound can be used. In particular, known sulfur compounds such as thiosulfate (e.g., sodium thiosulfate), thiourea (e.g., diphenylthiourea, triethylthiourea, allylthiourea), rhodanine and mercapto compounds can be used.

In the selenium sensitization process, known unstable selenium compounds can be used. In particular, known selenium compounds such as colloidal metallic selenium, selenourea (e.g., N,N-dimethylselenourea, N,N-diethylselenourea), selenoketone and selenoamide can be used.

In the noble metal sensitization process, a noble metal such as gold, platinum, palladium and iridium can be used. Particularly preferred among these noble metals is gold. Specific examples of gold compounds to be used in the gold sensitization process include known gold compounds such as chloroauric acid, potassium chloroaurate, potassium aurithiocyanate, gold sulfide, and gold selenide.

In the reduction sensitization process, known reducing compounds can be used. Specific examples of such known reducing compounds include stannous chloride, aminoiminomethanesulfinic acid, hydrazine derivatives, borane compounds, silane compounds and polyamine compounds.

Particularly preferred among these chemical sensitization processes are sulfur sensitization, selenium sensitization, gold sensitization and combinations thereof.

The amount of the silver halide solvent to be used in the present invention generally depends on the composition of the silver halide to be used and other conditions but can range from $10^{-6}$ to $10^{-1}$ mol, preferably $10^{-5}$ to $3\times10^{-1}$ mol, more preferably $10^{-4}$ to $3\times10^{-1}$ mol per mol of silver halide (AgX). The amount of the silver halide solvent also depends on the type thereof. For example, the amount of a thiocyanate which belongs to the group (i) above is preferably in the range of $5\times10^{-4}$ to $5\times10^{-1}$ mol, more preferably $1\times10^{-3}$ to $5\times10^{-1}$ mol. The amount Of a compound which belongs to the group (ii), (iii) or (iv) above is preferably in the range of $3\times10^{-4}$ to $3\times10^{\times1}$, more preferably $5\times10^{-4}$ to $5\times10^{-2}$ mol.

The emulsion to be used in the present invention is normally subjected to spectral sensitization before use.

A methine dye can be used as a spectral sensitizing dye in the present invention. Examples of such a methine dye include cyanine dye, melocyanine dye, composite cyanine dye, composite melocyanine dye, holopolar cyanine dye, hemicyanine dye, styryl dye and hemioxonol dye. Any nucleus which is commonly used as a basic heterocyclic nucleus for cyanine dye can be applied to these dyes. Examples of suitable nuclei which can be applied to these dyes include a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and a nucleus obtained by fusion of alicyclic hydrocarbon rings to these nuclei or a nucleus obtained by fusion of aromatic hydrocarbon rings to these groups, e.g., an indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus. These nuclei may be applied to carbon atoms in the dyes.

Examples of suitable nuclei which can be applied to melocyanine dye or composite melocyanine dye include those having a ketomethylene structure such as a 5- or 6-membered heterocyclic nucleus, e.g., pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

The amount of the sensitizing dye to be incorporated during the preparation of the silver halide emulsion cannot be unequivocally determined and depends on the type of the additives or the amount of the silver halide but is in substantially the same range as used in the prior art process.

In particular, the amount of the sensitizing dye to be incorporated is preferably in the range of 0.001 to 100 mmol, more preferably 0.01 to 10 mmol per mol of silver halide.

The sensitizing dye is incorporated before or after the chemical ripening. For the present silver halide grains, the sensitizing dye is most preferably incorporated during or before the chemical ripening (e.g., during the formation of grains or during the physical ripening).

In combination with the sensitizing dye, a dye which does not exhibit a spectral sensitizing effect itself or a substance which does not substantially absorb visible light but exhibits a supersensitizing effect can be incorporated in the emulsion. Examples of such a dye or substance include aminostyryl compounds substituted by nitrogen-containing heterocyclic groups as described in U.S. Pat. Nos. 2,933,390 and 3,635,721, aromatic organic acid-formaldehyde condensates as described in U.S. Pat. No. 3,743,510, cadmium salts, and azaindene compounds. Combinations described in U.S. Pat. Nos. 3,615,613, 3,615,641, 3,617,295, and 3,635,721 are particularly useful.

The photographic emulsion in the present invention can comprise various compounds for the purpose of inhibiting fogging during the preparation, storage or photographic processing of the light-sensitive material or stabilizing the photographic properties. In particular, many compounds known as fog inhibitors or stabilizers can be used. Examples of these fog inhibitors or stabilizers include azoles such as benzothiazolium salt, nitroindazoles, triazoles, benzotriazoles or benzimidazoles (particularly nitro- or halogen-substituted benzimidazoles), heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) or mercaptopyrimidines, similar heterocyclic mercapto compounds containing water-soluble groups such as carboxyl groups or sulfone groups, thioketo compounds such as oxazolinethion, azaindenes such as tetraazaindenes (particularly 4-hydroxyl-substituted (1,3,3*a*,7)tetrazaindenes), benzenethiosulfonic acids, and benzenesulfinic acid.

The addition of these fog inhibitors or stabilizers is normally effected after chemical sensitization. Preferably, the addition of these additives is effected during or before chemical ripening. More preferably, it is effected during the addition of the silver salt solution, between the end of the addition of the silver salt solution and the beginning of the chemical ripening, or during the chemical ripening (preferably between the beginning and the first 50%, more preferably the first 20%, of the chemical ripening) in the process of formation of silver halide emulsion grains.

The emulsion of the present invention can be incorporated in a photographic light-sensitive material having any layer structure, regardless of the number of layers comprising the emulsion layer (i.e., a single layer or multiple layers).

The silver halide multilayer color photographic material comprising the emulsion prepared according to the present invention has a multilayer structure comprising a lamination of emulsion layers containing a binder and silver halide grains so that blue light, green light and red light are recorded. Each emulsion layer comprises at least two layers, i.e., a high sensitivity layer and a low sensitivity layer. Examples of particularly practical layer structures include the following, but the present invention is not limited to these examples in any way:

(1) BH/BL/GH,/GL/RH/RL/S;
(2) GH/BM/BL/GH/GM/GL/RH/RM/RL/S;
(3) BH/BL/GH/RH/GL/RL/S as described in U.S. Pat. No. 4,184,876; and
(4) BH/GH/RH/BL/GL/RL/S as described in RD-22534 and JP-A-59-177551and JP-A 59-177552, wherein B represents a blue-sensitive layer; G represents a green-sensitive layer; R represents a red-sensitive layer; H represents a maximum sensitivity layer; M represents a middle sensitivity layer; L represents a low sensitivity layer; and S represents a support, the symbols of light-insensitive layers such as a protective layer, filter layer, intermediate layer, antihalation layer and subbing layer being omitted.

Preferred among these layer structures are (1), (2) and (4). Other preferred examples of layer structures include the following, but the present invention is not limited to these examples in any way:

(5) BH/BL/CL/GH/GL/RH/RL/S, and
(6) BH/BL/GH/GL/CL/RH/RL/S as described in JP-A-61-34541, wherein CL represents an interimage effectproviding layer; and the other symbols are as defined above.

Furthermore, a high sensitivity layer and a low sensitivity layer having the same color sensitivity may be reversed.

As described above, the silver halide emulsion of the present invention can be applied to a color light-sensitive material. The silver halide emulsion of the present invention can be similarly applied to any other light-sensitive materials such as X-ray-sensitive material, black-and-white light-sensitive material for photography, light-sensitive material for plate making or photographic paper, regardless of the number of layers comprising the emulsion layer (i.e., a single layer or multiple layers).

There are no specific limitations on the various additives to be incorporated in the present silver halide emulsion. The additives can include a binder, chemical sensitizer, spectral sensitizer, stabilizer, gelatin hardener, surface active agent, antistatic agent, polymer latex, matting agent, color coupler, ultraviolet absorber, discoloration inhibitor or dye. There are also no specific limitations on the support for the light-sensitive material comprising these emulsions, the coating method, the exposure method, the development method, etc. In this respect, one can refer to *Research Disclosure* Nos. 17643 (Vol. 176), 18716 (Vol. 187), and 22534 (Vol. 225).

Descriptive passages in these *Research Disclosure* publications are as set forth in Table 1 below:

TABLE 1

| Additives | RD17643 | RD18716 | RD-22534 |
|---|---|---|---|
| 1. Chemical Sensitizer | p. 23 | Right column on p. 648 | p. 24 |
| 2. Sensitivity Improver | — | Right column on p. 648 | — |
| 3. Spectral Sensitizer, Supersensitizer | pp. 23 to 24 | Right column on p. 648 right column on p. 649 | pp. 24 to 28 |
| 4. Brightening Agent | p. 24 | — | — |
| 5. Fog Inhibitor and Stabilizer | pp. 24 to 25 | Right column on p. 649 | p. 24, p. 31 |
| 6. Light Absorber, Filter Dye, Ultraviolet Absorber | pp. 25 to 26 | Right column on p. 649 left column on p. 650 | — |
| 7. Stain Inhibitor | Right column on p. 25 | Left column and right column on p. 650 | — |
| 8. Dye Stabilizer | p. 25 | — | p. 32 |
| 9. Film Hardener | p. 26 | Left column on p. 651 | p. 28 |
| 10. Binder | p. 26 | Left column on p. 651 | — |
| 11. Plasticizer, Lubricant | p. 27 | Right column on p. 650 | — |
| 12. Coating Aid, Surface Active Agent | pp. 26 to 27 | Right column on p. 650 | — |
| 13. Antistatic Agent | p. 27 | Right column on p. 650 | — |
| 14. Color Coupler | p. 25 | p. 649 | p. 31 |

The present invention will be further described in the following examples, but the present invention should not be construed as being limited thereto.

EXAMPLE 1

Tabular Silver Bromoiodide Grains

Emulsion of Finely Divided Silver Bromoiodide Particle (I-A)

120 ml of a 1.2 M silver nitrate solution and 120 ml of an aqueous solution of halide containing 1.11 M potassium bromide and 0.09 M potassium iodide were added to 2.6 l of 2.0 wt % gelatin solution containing 0.026 M potassium bromide over 15 minutes in a double jet process while stirring. During the process, the gelatin solution was kept at a temperature of 35° C. The emulsion was then washed in a flocculation process. Next, 30 g of gelatin was dissolved in the emulsion. The emulsion was then adjusted to a pH value of 6.5 and a pAg value of 8.6. The finely divided silver bromoiodide particles thus obtained (silver iodide content: 7.5%) had a mean grain size of 0.07 μm.

Core Emulsion of Tabular Silver Bromide Grains (I-B)

30 ml of a 2.0 M silver nitrate solution and 30 ml of 2.0 M potassium bromide solution were added to 2 l of 0.8 wt% gelatin solution containing 0.09 M potassium bromide in a double jet process while stirring. During the process, the gelatin solution in the reaction vessel was kept at a temperature of 30° C. After the addition, the temperature of the emulsion was raised to 75° C., and 40 g of gelatin was then added to the emulsion. A 1.0 M silver nitrate solution was then added to the emulsion in such an amount that the pBr value thereof reached 2.55. Then, 150 g of silver nitrate was added to the emulsion in an accelerating flow rate (the flow rate at the end was 10 times that at the beginning) in 60 minutes. At the same time, a potassium bromide solution was added to the emulsion in a double jet process in such an amount that the pBr value thereof remained at 2.55.

The emulsion was then cooled to 35° C. and rinsed in the ordinary flocculation process. 60 g of gelatin was then dissolved in the emulsion at a temperature of 40° C. The emulsion was then adjusted to a pH value of 6.5 and a pAg value of 8.6. Thus, a monodisperse emulsion of tabular silver bromide grains having a mean diameter of 1.4 μm (as calculated in terms of the circle corresponding to the projected area), a thickness of 0.2 μm and a diameter fluctuation coefficient of 15% (as calculated in terms of the circle corresponding to the projected area) was obtained.

Emulsion of Tabular Silver Bromoiodide Grains (I-C) (Comparison Emulsion)

Emulsion I-B containing silver bromide in an amount of 50 g (as calculated in terms of silver nitrate) was dissolved in 1.1 l of water. The emulsion was then kept at a temperature of 75° C. and a pBr value of 1.5. 1 g of 3,6-dithiaoctane-1,8-diol was added to the emulsion. 100 g of silver nitrate and a potassium bromide solution containing 7.5 mol% of potassium iodide were immediately added to the emulsion at a constant flow rate in an equimolecular amount in 50 minutes. The emulsion was then rinsed in the ordinary flocculation process. The emulsion was then adjusted to a pH value of 6.5 and a pAg of 8.6. Thus, an emulsion of tabular silver bromoiodide grains having a mean diameter of 2.3 μm (as calculated in terms of the circle corresponding to the projected area) and a thickness of 0.30 μm was obtained. The grains comprised silver halide in the core thereof and silver bromoiodide containing 7.5 mol % of silver iodide in the shell thereof.

Emulsion of Tabular Silver Bromoiodide Grains (I-D) (Present Invention)

Emulsion I-D was prepared in the same manner as in Emulsion I-C except that Emulsion I-A was charged into the reaction vessel at a constant flow rate in an amount of 100 g (as calculated in terms of silver nitrate) in 50 minutes instead of the addition of the aqueous solution of silver nitrate and the aqueous solution of halide. Thus, an emulsion of tabular grains having a mean diameter of 2.4 μm (as calculated in terms of the circle corresponding to the projected area) and a thickness of 0.31 μm was obtained.

Emulsion I-C and Emulsion I-D (each having a pH value of 6.5 and a pAg value of 8.6) were each divided into 4 parts. 5,5'-dichloro-9-ethyl-3,3'(3-sulfopropyl)oxacarbocyanine was then added to these parts as a sensitizing dye in an amount of 280 mg per mol of silver halide. Sodium thiosulfate was then added to the parts in an amount of $8\times10^{-6}$ mol. The present compounds as set forth in Table 2 were then added to the parts. The parts were then subjected to optimum chemical ripening at a temperature of 60° C.

After the chemical sensitization, 100 g of each part (each containing 0.08 mol of Ag) was then subjected to dissolution at a temperature of 40° C. The following compositions i. to iv. were then added to each lot in sequence with stirring.

| | |
|---|---|
| i. 4-Hydroxy-6-methyl-1,3,3a,7-tetrazaindene (3 wt %) | 2 cc |
| ii. $C_{17}H_{35}-O-(CH_2CH_2O)_{25}-H$ (2 wt %) | 2.2 cc |
| iii. 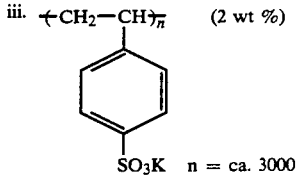 (2 wt %) | 1.6 cc |
| iv. 2,4-Dichloro-6-hydroxy-s-triazine sodium (2 wt %) | 3 cc |

A surface protective coating solution was then prepared by charging the following components i. to v. in sequence while stirring.

| | |
|---|---|
| i. 14 wt % Aqueous solution of gelatin | 56.8 g |
| ii. Finely divided grains of polymethyl methacrylate (mean grain size: 3.0 μm) | 3.9 g |
| iii. Emulsion | |
| Gelatin (10 wt %) | 4.24 g |
| $NaO_3S-CH(CH_2COOCH_2CH(C_2H_5)C_4H_9)COOCH_2CH(C_2H_5)C_4H_9$ | 10.6 mg |
| 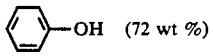 (72 wt %) | 0.02 cc |

-continued

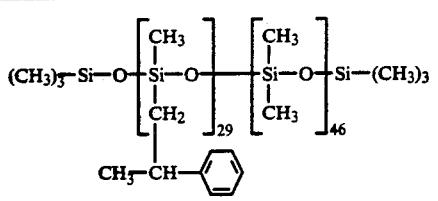

0.424 cc iv. $H_2O$ 68.8 cc v. 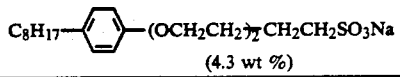 3 cc (4.3 wt %)

The emulsion coating solutions and the surface protective solution thus obtained were then coated on a polyethylene terephthalate film support in a simultaneous extrusion process in amounts such that the rate of volume of coating reached 103 : 45 at the time of coating. The coated amount of silver was 3.1 g/m$^2$. These samples were then exposed to light through a yellow filter and an optical wedge for 1/100 second in a sensitometer, developed at a temperature of 35° C. for 30 seconds with a developer RD-III for an automatic developing machine (Fuji Photo Film Co., Ltd.), and subjected to ordinary fixation, rinsing and drying. The samples were measured for photographic sensitivity, which is the reciprocal of the exposure required to obtain an optical density of fog value +0.2, considering the sensitivity of Sample 1 to be 100.

TABLE 2

| Sample | Emulsion | Silver Halide Solvent: Compound | Silver Halide Solvent: Added Amount (Mol/Mol AgX) | Fog | Relative Sensitivity |
|---|---|---|---|---|---|
| 1 (Comparison) | I-C | — | — | 0.12 | 100 |
| 2 (Comparison) | " | (1) | $2.4 \times 10^{-3}$ | 0.18 | 122 |
| 3 (Comparison) | " | (6) | $8 \times 10^{-4}$ | 0.14 | 135 |
| 4 (Comparison) | " | (34) | $8 \times 10^{-4}$ | 0.20 | 120 |
| 5 (Comparison) | I-D | — | — | 0.10 | 200 |
| 6 (Present Invention) | " | (1) | $2.4 \times 10^{-3}$ | 0.10 | 280 |
| 7 (Present Invention) | " | (6) | $8 \times 10^{-4}$ | 0.11 | 310 |
| 8 (Present Invention) | " | (34) | $8 \times 10^{-4}$ | 0.10 | 295 |

Table 2 shows that the emulsion prepared according to the prior art process exhibit a rise in the sensitivity but suffer from a remarkable fog when a silver halide solvent is used upon chemical ripening. In contrast, the emulsions prepared according the present invention exhibit little or no fog and a significant rise in the sensitivity.

EXAMPLE 2

Emulsion I-C and Emulsion I-D were prepared in the same manner as in Example 1. These samples were each divided into 4 parts. The same dyes as used in Example 1 were added to each lot. Sodium thiosulfate, chloroauric acid and potassium thiocyanate were then added to each part in amounts of $1 \times 10^{-5}$ mol/mol Ag, $2 \times 10^{-5}$ mol/mol Ag and $3.2 \times 10^{-4}$ mol/mol Ag, respectively The present compounds as set forth in Table 3 were then added to each part. Each emulsion was then subjected to optimum chemical ripening at a temperature of 60° C.

After the chemical sensitization, coating specimens were obtained as in Example 1. The results are set forth in Table 3. The photographic sensitivity is represented relative to that of Sample 9, which is considered to be 100.

TABLE 3

| Sample | Emulsion | Silver Halide Solvent: Compound | Silver Halide Solvent: Added Amount (Mol/Mol AgX) | Fog | Relative Sensitivity |
|---|---|---|---|---|---|
| 9 (Comparison) | I-C | — | — | 0.16 | 100 |
| 10 (Comparison) | " | (1) | $2.4 \times 10^{-3}$ | 0.21 | 122 |
| 11 (Comparison) | " | (6) | $8 \times 10^{-4}$ | 0.18 | 135 |
| 12 (Comparison) | " | (34) | $8 \times 10^{-4}$ | 0.18 | 138 |
| 13 (Comparison) | I-D | — | — | 0.10 | 250 |
| 14 (Present Invention) | " | (1) | $2.4 \times 10^{-3}$ | 0.10 | 338 |
| 15 (Present Invention) | " | (6) | $8 \times 10^{-4}$ | 0.11 | 375 |
| 16 (Present Invention) | " | (34) | $8 \times 10^{-4}$ | 0.10 | 385 |

Table 3 shows that the emulsions prepared according to the present invention exhibit a remarkably great sensitizing effect in the green sensitivity by a silver halide solvent when gold sensitization is effected in combination as compared to the prior art emulsions. Moreover, the emulsions prepared according to the present invention suffer from little or no fog.

Silver Halide Solvent (1) is normally used as a ligand for gold sensitization. When Silver Halide Solvent (1) is added to the prior art emulsions in a large amount, much fog is produced. In contrast, even when the compound is added to the present emulsions, little or no fog is produced, and a remarkable rise in the sensitivity results.

Further, samples prepared in the same manner as above except adding to Emulsion I-C Silver Halide Solvents (14), (17), (31), (36), (42) and (46) each in an amount of $8 \times 10^{-4}$ mol/mol AgX, and Silver Halide Solvents (28), (29), (49) and (52) each in an amount of $6 \times 10^{-4}$ mol/mol AgX, exhibited a relative sensitivity ranging from 120 to 140 and a fog value of from 0.16 to 0.25. In contrast, the corresponding samples using the present Emulsion I-D exhibited a relative sensitivity ranging from 320 to 420 and a fog value of 0.13 or less.

Samples 9, 10, 12, 13, 14 and 16 were also developed at a temperature of 35° C. for 15 seconds. The results are set forth in Table 4. (The sensitivity obtained from the Samples after they have been developed for 30 seconds is considered to be 100.)

TABLE 4

| Sample | Relative Sensitivity 15 seconds | 30 seconds (reference) | Remarks |
|---|---|---|---|
| 9 | 52 | 10 | Comparison |
| 10 | 65 | 100 | " |
| 12 | 68 | 100 | " |
| 13 | 60 | 100 | " |
| 14 | 82 | 100 | Present Invention |
| 16 | 85 | 100 | Present Invention |

It is obvious that the Present Invention Samples can be developed at a higher speed than the Comparison Samples and thus are suited for rapid processing.

Even when the sensitizing dye to be used for the chemical ripening in Example 1 was replaced by a dye such as 9-methyl-3,3'-(4-sulfobutyl)thiacarbocyanine, 5,5'-dichloro-9-ethyl-3,3'-(3-sulfopropyl)thiacarbocyanine, 5,5'-dichloro-6-cyano-6'-trichloromethyl1,1'-diethyl-3,3'-(4-sulfobutyl)imidacarbocyanine or 9-methyl-3,3'-ethylselenacarbocyanine, the resulting samples of the present invention can be developed at a remarkably higher speed than the prior art samples. Thus, the present silver halide emulsions are suited for rapid processing using a spectral sensitizing dye.

EXAMPLE 3

Tabular Silver Bromide Grains

Emulsion of Tabular Silver Bromide Grains (II-A) (Comparison)

Emulsion II-A was prepared with Emulsion I-B as obtained in Example 1 as a core in the same manner as in Emulsion I-C of Example 1 except that 4 cc of ammonia (25 wt %) was used instead of 3,6-dithiaoctane-1,8-diol, and an aqueous solution of silver nitrate and an aqueous solution of potassium bromide were added in equimolecular amounts. The resulting emulsion of tabular silver bromide had a mean grain diameter of 2.0 μm (as calculated in terms of the circle corresponding to the projected area) and a grain thickness of 0.39 μm (core/shell ratio = ½).

Emulsion of Tabular Silver Bromide Grains (II-B) (Present Invention)

Emulsion II-B was prepared with Emulsion I-B as obtained in Example 1 as a core in the same manner as Emulsion II-A except that after the addition of ammonia, extremely fine particles produced by charging 600 ml of a 1 M aqueous solution of silver nitrate, 600 ml of a 1 M potassium bromide and 400 ml of a 2 wt % aqueous solution of gelatin by a triple jet process into a powerful mixer with a high stirring efficiency provided close to the reaction vessel and maintained at a temperature of 30° C. were continuously introduced into the reaction vessel to shell the cores. The resulting emulsion of tabular silver bromide grains has a mean grain diameter of 2.1 μm (as calculated in terms of the circle corresponding to the projected area) and a grain thickness of 0.38 μm (core/shell ratio = ½).

The emulsions thus obtained were both rinsed in the ordinary flocculation process. Gelatin was then added to the emulsions and then they were adjusted to a pH value of 6.3 and a pAg value of 8.2. The two emulsions were each divided into 3 parts. The same dyes as used in Example 1 were added to each part. N,N-dimethylselenourea was added to each part in an amount of $4\times10^{-6}$ mol/mol Ag. The present compounds were then added to each part. These emulsions were then subjected to optimum chemical ripening at a temperature of 58° C.

These samples were then processed in the same manner as in Example 1. The results are set forth in Table 5.

TABLE 5

| Sample | Emulsion | Silver Halide Solvent Compound | Added Amount (Mol/Mol AgX) | Fog | Relative Sensitivity |
|---|---|---|---|---|---|
| 17 (Comparison) | II-A | — | — | 0.52 | 100 |
| 18 (Comparison) | " | (1) | $3\times10^{-3}$ | 0.40 | 112 |
| 19 (Comparison) | " | (36) | $6\times10^{-4}$ | 0.38 | 114 |
| 20 (Comparison) | II-B | — | — | 0.23 | 138 |
| 21 (Present Invention) | " | (1) | $3\times10^{-3}$ | 0.18 | 195 |
| 22 (Present Invention) | " | (36) | $6\times10^{-4}$ | 0.16 | 208 |

Table 5 shows that the Present Invention Samples produce less fog and can provide a higher sensitivity when an silver halide solvent is used in combination with selenium sensitization than the Comparison Samples.

EXAMPLE 4

Octahedral Silver Bromoiodide Grains)

Emulsion (III-A) (Comparison)

20 ml of a 5% aqueous solution of 3,6-dithiaoctane-1,8-diol was added to 1.2 l of a 3.0 wt% gelatin solution containing 0.06 M potassium bromide while stirring in a reaction vessel. The material was kept at a temperature of 75° C. Then, 50 cc of a 0.3 M silver nitrate solution and 50 cc of an aqueous solution of halide containing 0.063 M potassium iodide and 0.19 M potassium bromide were added to the material in the reaction vessel in a double jet process in 3 minutes Thus, silver bromoiodide grains having a mean diameter of 0.2 μm (as calculated in terms of the circle corresponding to the projected area) and a silver iodide content of 25 mol % were obtained as cores. Then, 60 ml of 3,6-dithiaoctane-1,8-diol was further added to the cores at a temperature of 75° C. Next, 800 ml of 1.5 M silver nitrate and 800 ml of halide solution containing 0.375 M potassium iodide and 1.13 M potassium bromide were simultaneously added to the material in a double jet process in 100 minutes to form the first coating layer thereon. The resulting emulsion of octahedral silver bromoiodide grains had a mean grain diameter of 0.95 μm (silver iodide content: 25 mol %).

Then, 0.06 mol of hydrogen peroxide was added to the emulsion. A 1.5 M aqueous solution of silver nitrate and a 1.5 M aqueous solution of potassium bromide were simultaneously added to the emulsion as core emulsion in equimolecular amounts to form a silver bromide shell (the second coating layer) thereon. The molar ratio of the first coating layer to the second coating layer is 1 : 1. The resulting core/shell type monodisperse emulsion of octahedral grains had a mean grain diameter of 1.2 μm and contained 25 mol % of silver iodide therein.

Emulsion III-B (Present Invention)

Emulsion cores were prepared in the same manner as in Emulsion III-A. Then, 3,6-dithiaoctane-1.8-diol was added to the emulsion cores. Next, 800 ml of 1.5 M silver nitrate, 800 ml of a halide solution containing 0.375 M potassium iodide and 1.13 M potassium bromide, and 500 ml of a 2 wt % aqueous solution of gelatin were simultaneously charged into a powerful mixer with a high stirring efficiency provided close to the reaction vessel in a triple jet process in 100 minutes. During the process, the mixer was kept at a temperature of 30° C. The resulting extremely fine particles were immediately and continuously introduced into the reaction vessel which had been kept at a temperature of 75° C. to form the first coating layer. Hydrogen peroxide was then added to the material. A 1.5 M silver halide solution, a 1.5 M potassium bromide solution and a 2 wt % gelatin solution were charged into the mixer and then introduced in the form of fine particles into the reaction vessel to form a silver bromide shell (the second coating layer) thereon. Thus, grains having a first coating layer/second coating layer ratio of 1 : 1 were obtained. The resulting core/shell type monodisperse emulsion of octahedral grains had a mean grain diameter of 1.2 μm (as calculated in terms of the circle corresponding to the projected area).

The emulsions thus obtained were each divided into 5 parts. These parts were then kept at a temperature of 56° C. The Silver Halide Solvents set forth in Table 6 were then added to these emulsions. Sodium thiosulfate, chloroauric acid and potassium thiocyanate were then added to these emulsions in amounts of $1.2\times10^{-5}$ mol/mol Ag, $1.6\times10^{-5}$ mol/mol Ag and $2.5\times10^{-4}$ mol/mol Ag, respectively. These emulsions were then subjected to optimum chemical ripening. The compounds set forth below were then added to the emulsions. These emulsions were coated on a triacetyl cellulose film support having a subbing layer in a simultaneous extrusion process together with a protective layer.

(1) Emulsion Layer

Emulsion: Emulsion set forth in Table 6

Coupler

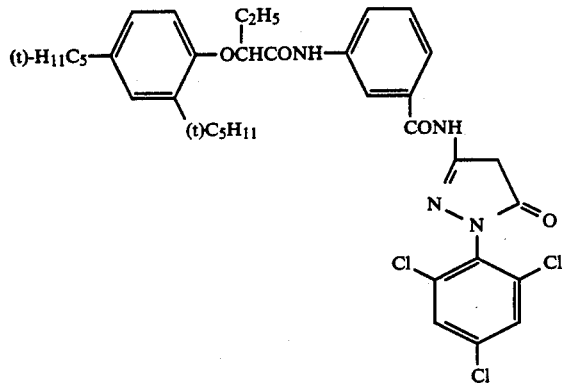

Tricresyl phosphate

Sensitizing Dye: 5-chloro-5'-phenyl-9-ethyl-3,3'-(3-sulfopropyl)oxacarbocyanine sodium salt
Stabilizer: 4-Hydroxy-6-methyl-1,3,3*a*,7-tetrazaindene
Fog Inhibitor: 1-(m-sulfophenyl)-5-mercaptotetrazole
Coating Aid: Sodium dodecylbenzenesulfonate (2) Protective Layer 2,4-Dichloro-6-hydroxy-s-triazine sodium salt Gelatin The thus prepared samples were then exposed to light through a yellow filter for sensitometry and subjected to the following color development.

The development was carried out at a temperature of 38° C. as follows:

| | | |
|---|---|---|
| 1. | Color development | 2 min. 45 sec. |
| 2. | Bleach | 6 min. 30 sec. |
| 3. | Rinse | 3 min. 15 sec. |
| 4. | Fixation | 6 min. 30 sec. |
| 5. | Rinse | 3 min. 15 sec. |
| 6. | Stabilization | 3 min. 15 sec. |

The compositions of the processing solutions used in these processes were as follows:

Color Developing Solution

| | |
|---|---|
| Color Developing Solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)-2-methyl-aniline sulfate | 4.5 g |
| Water to make | 1 l |
| Bleaching Solution | |
| Ammonium bromide | 160.0 g |
| Aqueous ammonia (28 wt %) | 25.0 ml |
| Sodium ethylenediaminetetraacetate | 130 g |
| Glacial acetic acid | 14 ml |
| Water to make | 1 l |
| Fixing Solution | |
| Sodium tetrapolyphosphate | 2.0 g |
| Sodium sulfite | 4.0 g |
| Ammonium thiosulfate (70 wt %) | 175.0 ml |
| Sodium bisulfite | 4.6 g |
| Water to make | 1 l |
| Stabilizing Solution | |
| Formaldehyde (30% Aq. Soln.) | 8.0 ml |

-continued

| | |
|---|---|
| Water to make | 1 l |

The samples thus processed were then measured through a green filter for density. The results of photographic properties are set forth in Table 6.

The photographic sensitivity was determined relative to that of sample 23, which was considered to be 100.

TABLE 6

| Sample | Emulsion | Silver Halide Solvent Compound | Silver Halide Solvent Added Amount (Mol/Mol AgX) | Fog | Relative Sensitivity |
|---|---|---|---|---|---|
| 23 (Comparison) | III-A | — | — | 0.12 | 100 |
| 24 (Comparison) | " | (3) | $4 \times 10^{-3}$ | 0.14 | 115 |
| 25 (Comparison) | " | (9) | $1 \times 10^{-3}$ | 0.15 | 118 |
| 26 (Comparison) | " | (30) | $4 \times 10^{-4}$ | 0.18 | 122 |
| 27 (Comparison) | " | (34) | $8 \times 10^{-4}$ | 0.15 | 118 |
| 28 (Comparison) | III-B | — | — | 0.12 | 125 |
| 29 (Present Invention) | " | (3) | $4 \times 10^{-3}$ | 0.12 | 195 |
| 30 (Present Invention) | " | (9) | $1 \times 10^{-3}$ | 0.12 | 200 |
| 31 (Present Invention) | " | (30) | $4 \times 10^{-4}$ | 0.14 | 195 |
| 32 (Present Invention) | " | (34) | $8 \times 10^{-4}$ | 0.12 | 210 |

Table 6 shows that the prior art emulsions exhibit only a small rise in the sensitivity in the green zone with a silver halide solvent. Also, the prior art emulsions suffer from some fog.

In contrast, the present emulsions exhibit a remarkably great rise in the sensitivity with a silver halide solvent.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion layer on a support, wherein light-sensitive silver halide grains in said at least one silver halide emulsion layer are obtained by charging previously prepared silver halide particles having a fine grain size into a reaction vessel which allows at least one of nucleation and crystallization of said light-sensitive silver halide grains so that at least one of nucleation and crystallization is effected in said reaction vessel, and said light-sensitive silver halide grains are subjected to chemical ripening in the presence of a silver halide solvent, wherein said silver halide particles having a fine grain size are formed by mixing an aqueous solution of a water-soluble silver salt and an aqueous solution of a water-soluble halide in a mixer provided outside said reaction vessel which allows at least one of nucleation and crystallization of light-sensitive silver halide grains, wherein an aqueous solution of protective colloid is charged into the mixer at a concentration of at least 2 wt % in at least one of the following ways:

(a) singly, (b) in the aqueous solution of a water-soluble silver salt, and (c) in the aqueous solution of a water-soluble halide.

2. A silver halide photographic material as claimed in claim 1, wherein the said silver halide particles having a fine grain size are immediately supplied to said reaction vessel so that they are used for at least one of nucleation and crystallization of said light-sensitive silver halide grains.

3. A silver halide photographic material as claimed in claim 2, wherein said silver halide particles having a fine size are formed when the agitating blade in said mixer rotates at a speed of at least 1000 r.p.m.

4. A silver halide photographic material as claimed in claim 1, wherein said silver halide solvent is selected from the group consisting of thiocyanates, thioether compounds, selenaether compounds, telluroether compounds, thiocarbonyl compounds, selenocarbonyl compounds, mercapto compounds, mesoionic compounds, sulfites and imino group-containing compounds.

5. A silver halide photographic material as claimed in claim 4, wherein said silver halide solvent is a compound represented by the formula (I):

$$R^1(X_2(R^3)_m-X_1-R^2 \quad \text{(I)}$$

Wherein m represents 0 or an integer of 1 to 12; $X_1$ and $X_2$ each is selected from the group consisting of a sulfur atom, a selenium atom, a tellurium atom and an oxygen atom, with the proviso that at least one of $X_1$ and $X_2$ is selected from the group consisting of a sulfur atom, a selenium atom and a tellurium atom; $R^1$ and $R^2$ may be the same or different and each represents a lower alkyl group or a substituted alkyl group; and $R^3$ represents an alkylene group.

6. A silver halide photographic material as claimed in claim 5, wherein at least one of $X_1$ and $X_2$ is a sulfur atom.

7. A silver halide photographic material as claimed in claim 4, wherein said silver halide solvent is a compound represented by the formula (II):

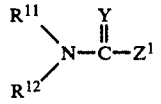

(II)

wherein $Z^1$ represents

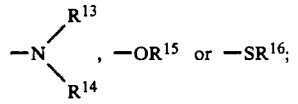

Y is selected from the group consisting of a sulfur atom, a selenium atom and a tellurium atom; and $R^{11}$, $R^{12}$, $R^{13}$, $R^{14}$, $R^{15}$ and $R^{16}$ may be the same or different, each representing an alkyl group, an alkenyl group, an aralkyl group, an aryl group or a heterocyclic residue, which may be substituted.

8. A silver halide photographic material as claimed in claim 7, wherein Y is a sulfur atom.

9. A silver halide photographic material as claimed in claim 4, wherein said silver halide solvent is a compound represented by the formula (III);

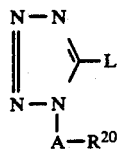

(III)

wherein A represents an alkylene group; $R^{20}$ represents $-NH_2$, $-NHR^{21}$,

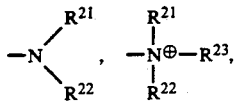

$-CONHR^{24}$, $-OR^{24}$, $-COOM^2$, $-COOR^{21}$, $-SO_2NHR^{24}$, $-NHCOR^{21}$ or $-SO_3M^2$; L represents $-SM^2$, except that L represents $-S^{\ominus}$ when $R^{20}$ is

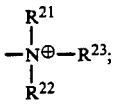

$R^{21}$, $R^{22}$ and $R^{23}$ each represents an alkyl group which may be substituted; $R^{24}$ represents a hydrogen atom or an alkyl group which may be substituted; and $M^2$ represents a hydrogen atom or a cation.

10. A silver halide photographic material as claimed in claim 4, wherein said silver halide solvent is a compound represented by the formula (IV):

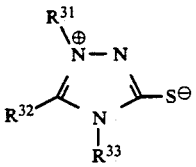

(IV)

wherein $R^{31}$ and $R^{32}$ each represents an alkyl group, an alkenyl group, an aryl group, an aralkyl group or a heterocyclic residue, which may be substituted; and $R^{33}$ represents an alkyl group, an alkenyl group, a cycloalkyl group, an aryl group, an aralkyl group, a heterocyclic residue, $-NH_2$, $-NHR^{21}$ or $-NR^{21}R^{22}$, which may be substituted, wherein $R^{21}$ and $R^{22}$ each represents an alkyl group which may be substituted.

11. A silver halide photographic material as claimed in claim 1, wherein said silver halide solvent is present in an amount of $10^{-6}$ to $10^{-1}$ mol per mole of silver halide.

12. A silver halide photographic material as claimed in claim 1, wherein said light-sensitive silver halide grains are subjected to at least one of sulfur sensitization, selenium sensitization, noble metal sensitization and reduction sensitization.

13. A process for the preparation of a silver halide photographic material comprising at least one silver halide emulsion layer on a support, wherein said process comprises obtaining light-sensitive silver halide grains in said at least one silver halide emulsion layer by charging previously prepared silver halide particles having a fine grain size into a reaction vessel which allows at least one of nucleation and crystallization of said light-sensitive silver halide grains so that at least one of nucleation and crystallization is effected in said reaction vessel, and subjecting said light-sensitive silver halide grains to chemical ripening in the presence of a silver halide solvent, wherein said process further comprises forming said silver halide particles having a fine grain size by mixing an aqueous solution of a water-soluble silver salt and an aqueous solution of a water-soluble halide in a mixer provided outside said reaction vessel which allows at least one of nucleation and crystallization of light-sensitive silver halide grains, wherein said process additionally comprises charging an aqueous solution of protective colloid into the mixer at a concentration of at least 2 wt % in at least one of the following ways:

(a) singly, (b) in the aqueous solution of a water-soluble silver salt, and (c) in the aqueous solution of a water-soluble halide.

14. A process for the preparation of a silver halide photographic material as claimed in claim 14, wherein the said silver halide particles having a fine grain size are immediately supplied to said reaction vessel so that they are used for at least one of nucleation and crystallization of said light-sensitive silver halide grains.

* * * * *